US010006252B2

(12) United States Patent
Cho et al.

(10) Patent No.: US 10,006,252 B2
(45) Date of Patent: Jun. 26, 2018

(54) DRILL BIT INCLUDING BUTTON ARRAY HAVING DIFFERENT RADII EXTENDING FROM CENTER OF HEAD SECTION

(71) Applicant: KOREA INSTITUTE OF INDUSTRIAL TECHNOLOGY, Cheonan-si, Chungcheongnam-do (KR)

(72) Inventors: Jung Woo Cho, Cheonan-si (KR); Dae Young Shin, Incheon (KR); Jin Seok Yang, Seoul (KR); Kyoung Il Moon, Incheon (KR); Ki Beom Kwon, Seoul (KR); Chang Heon Song, Anyang-si (KR); Joo Young Oh, Daejeon (KR)

(73) Assignee: KOREA INSTITUTE OF INDUSTRIAL TECHNOLOGY, Cheonan-si, Chungcheongnam-Do (KR)

( * ) Notice: Subject to any disclaimer, the term of this patent is extended or adjusted under 35 U.S.C. 154(b) by 561 days.

(21) Appl. No.: 14/410,071

(22) PCT Filed: May 27, 2013

(86) PCT No.: PCT/KR2013/004610
§ 371 (c)(1),
(2) Date: Dec. 20, 2014

(87) PCT Pub. No.: WO2013/191386
PCT Pub. Date: Dec. 27, 2013

(65) Prior Publication Data

US 2015/0308198 A1 Oct. 29, 2015

(30) Foreign Application Priority Data

Jun. 21, 2012 (KR) ..... 10-2012-0066979

(51) Int. Cl.
*E21B 10/36* (2006.01)
*E21B 10/56* (2006.01)
(Continued)

(52) U.S. Cl.
CPC ..... *E21B 10/56* (2013.01); *E21B 10/36* (2013.01); *E21B 10/43* (2013.01); *E21B 10/46* (2013.01); *E21B 10/54* (2013.01)

(58) Field of Classification Search
CPC ..... E21B 10/36; E21B 10/43; E21B 10/46; E21B 10/38; E21B 10/40
See application file for complete search history.

(56) References Cited

U.S. PATENT DOCUMENTS 3,071,201 A * 1/1963 Phipps ..... E21B 10/56 175/415
4,475,606 A * 10/1984 Crow ..... E21B 10/43 175/431
(Continued)

FOREIGN PATENT DOCUMENTS

JP 2004308292 11/2004
JP 2008121186 5/2008
(Continued)

OTHER PUBLICATIONS

International Search Report for PCT/KR2013/004610, English translation attached to original, Both completed by the Korean Patent Office on Aug. 21, 2013, All together 5 Pages.

*Primary Examiner* — Kipp C Wallace
(74) *Attorney, Agent, or Firm* — Brooks Kushman P.C.

(57) ABSTRACT

A drill bit including a button array having different radii extending from the center of a head section, and more particularly, to a drill bit in which buttons are arranged so as to have different radii from the center of a drill bit head section, thereby striking bedrock points having different radii and improving the efficiency of a drilling operation.

5 Claims, 17 Drawing Sheets

(51) Int. Cl.

| | |
|---|---|
| ***E21B 10/43*** | (2006.01) |
| ***E21B 10/54*** | (2006.01) |
| ***E21B 10/46*** | (2006.01) |

(56) References Cited

U.S. PATENT DOCUMENTS

| | | | | |
|---|---|---|---|---|
| 6,073,711 | A | 6/2000 | Ingmarsson | |
| 7,296,641 | B2 | 11/2007 | Hadin et al. | |
| 7,392,863 | B2 | 7/2008 | Bjork | |
| 2007/0125580 | A1* | 6/2007 | Hall | E21B 10/602 175/393 |
| 2007/0137900 | A1 | 6/2007 | Bjork | |
| 2007/0267227 | A1* | 11/2007 | Mensa-Wilmot | E21B 10/43 175/426 |
| 2009/0145669 | A1* | 6/2009 | Durairajan | E21B 10/55 175/431 |
| 2012/0125687 | A1 | 5/2012 | Rives | |
| 2012/0138365 | A1* | 6/2012 | Maurstad | E21B 10/43 175/57 |

FOREIGN PATENT DOCUMENTS

| | | |
|---|---|---|
| KR | 20060110271 | 10/2006 |
| KR | 20070053285 | 5/2007 |

* cited by examiner

[Fig. 1a]
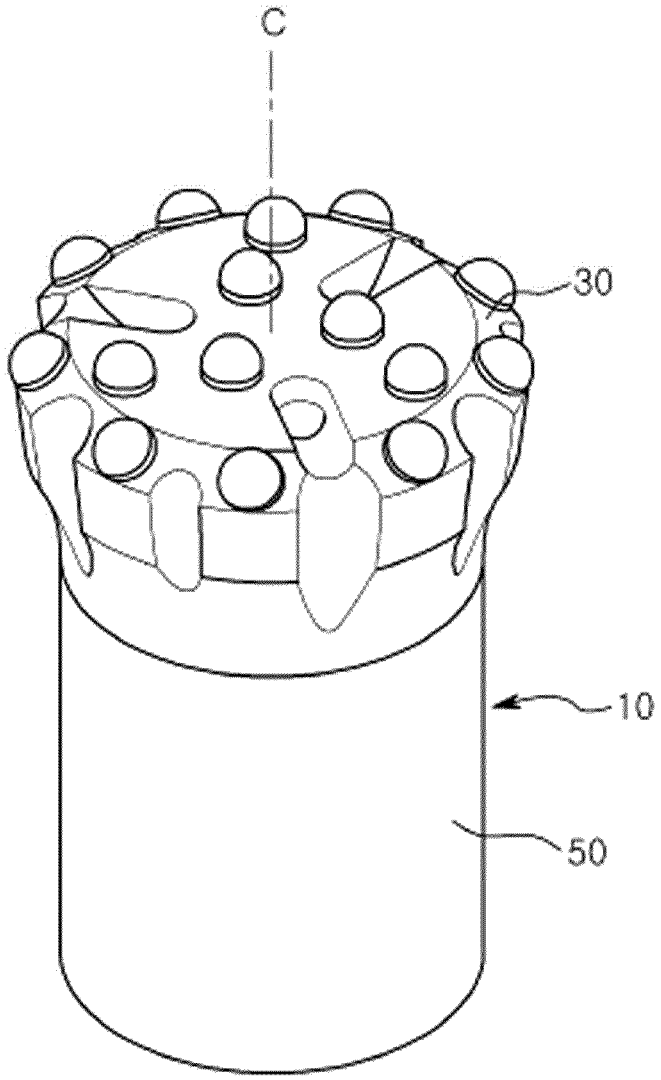

[Fig. 1b]
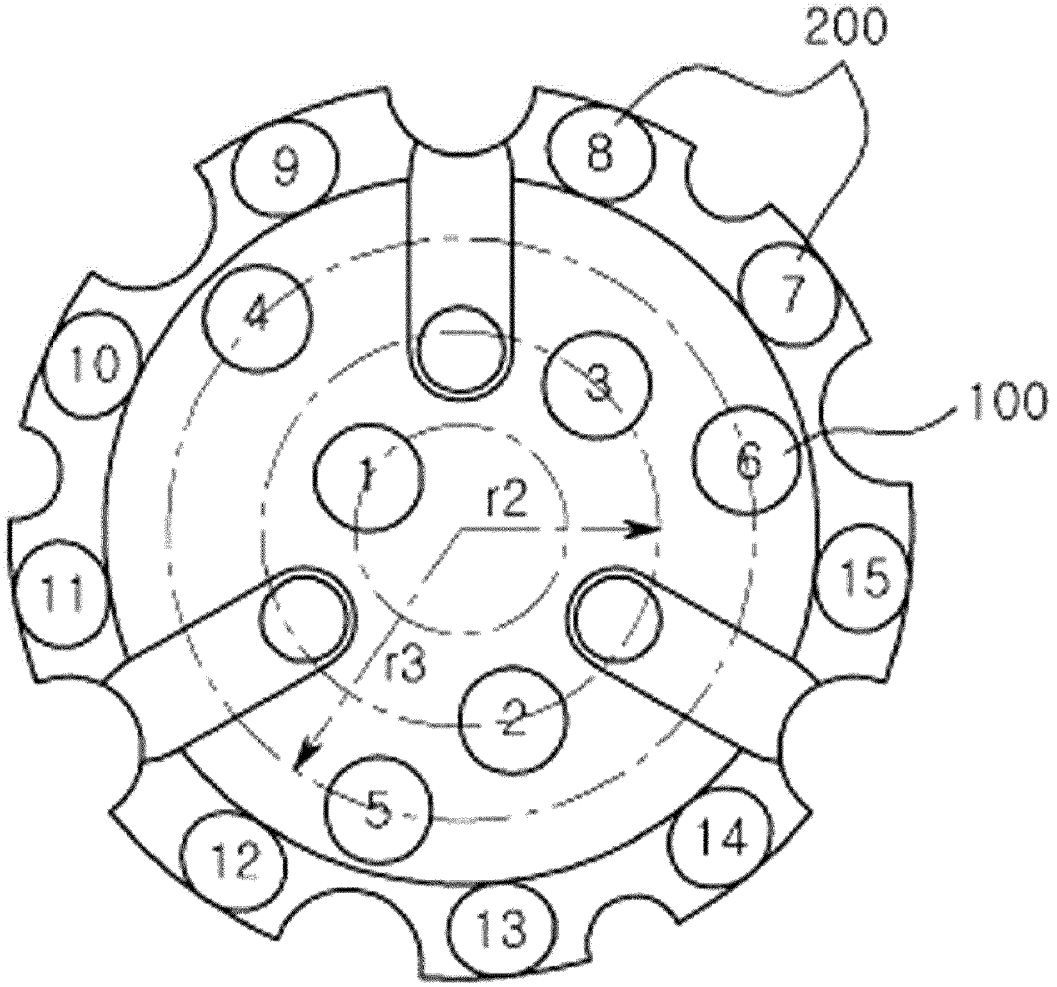

[Fig. 1c]
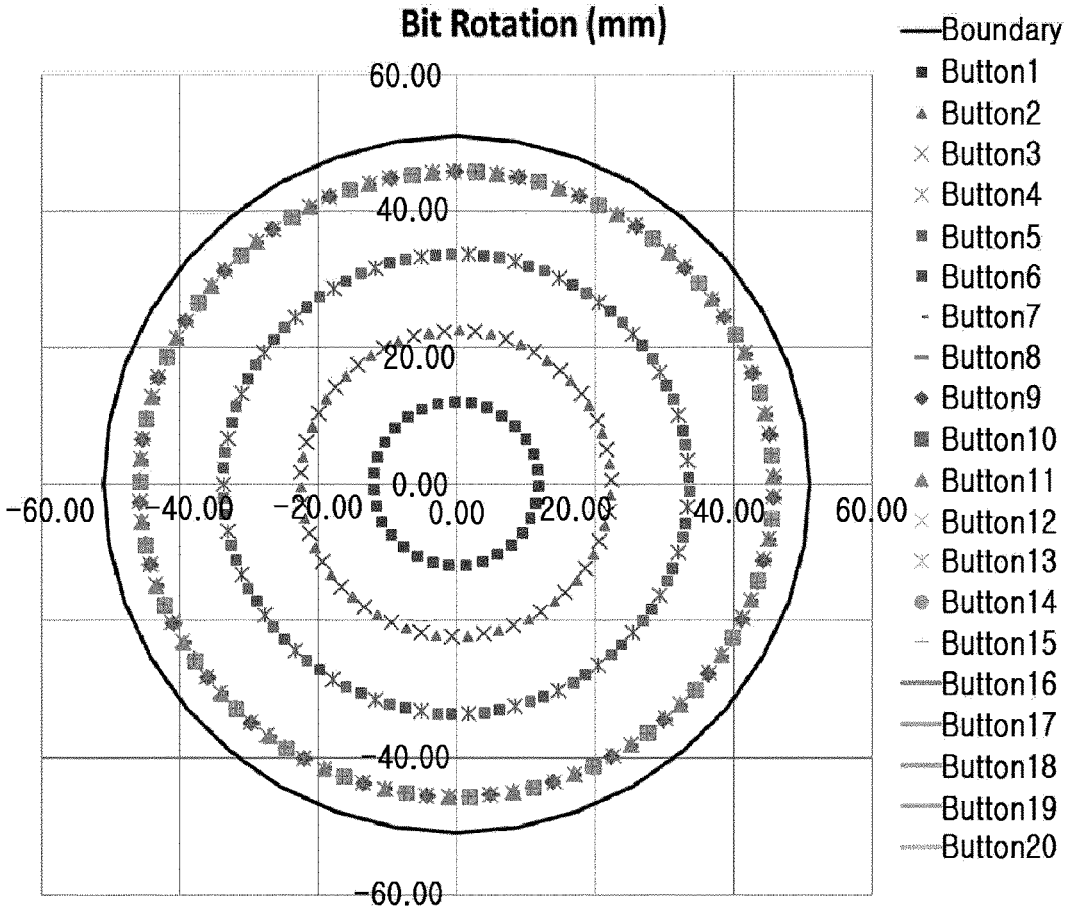

[Fig. 1d]
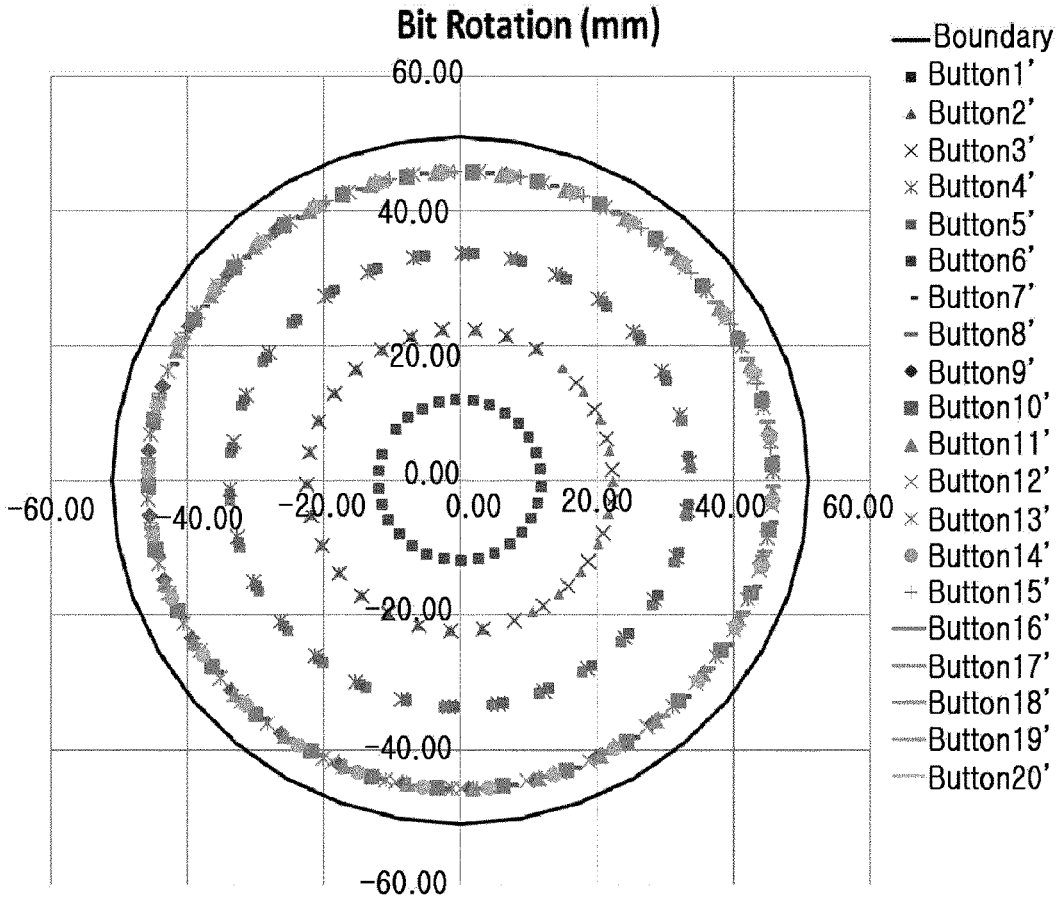

[Fig. 2]
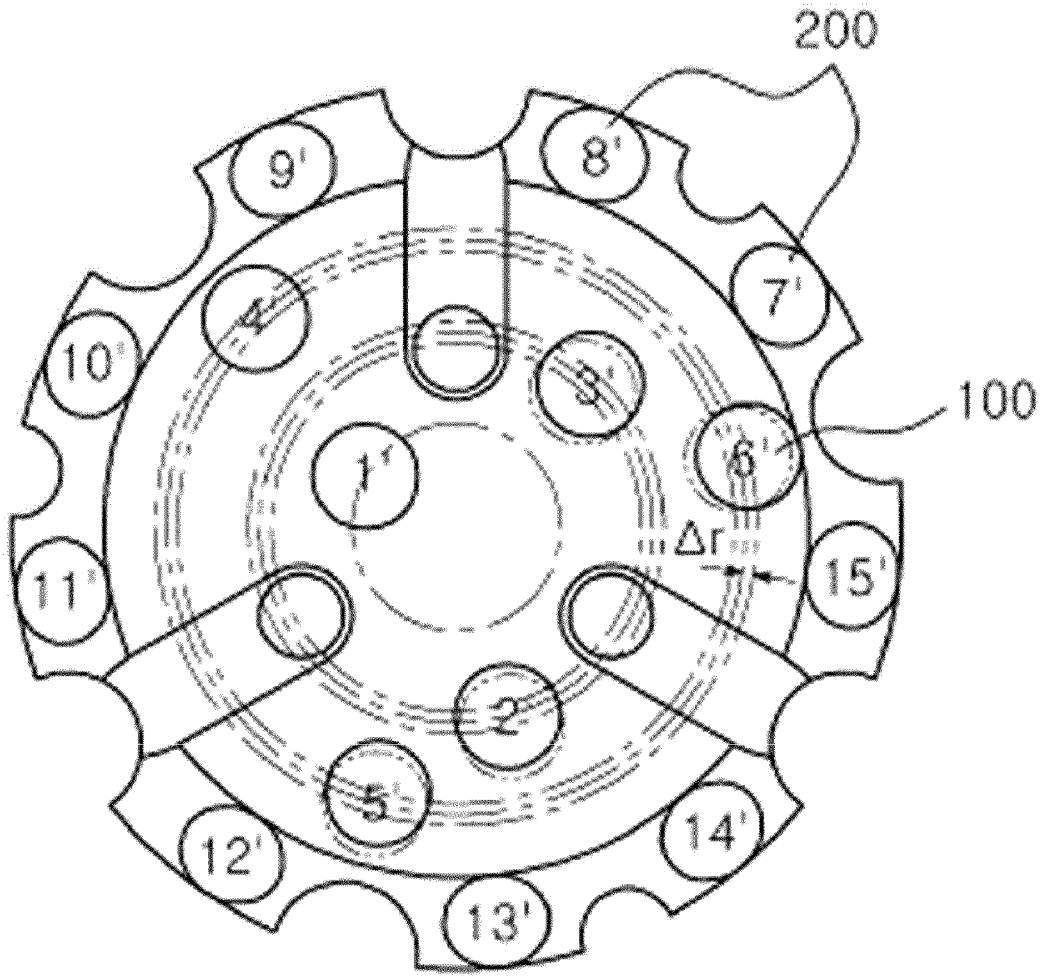

[Fig. 3]
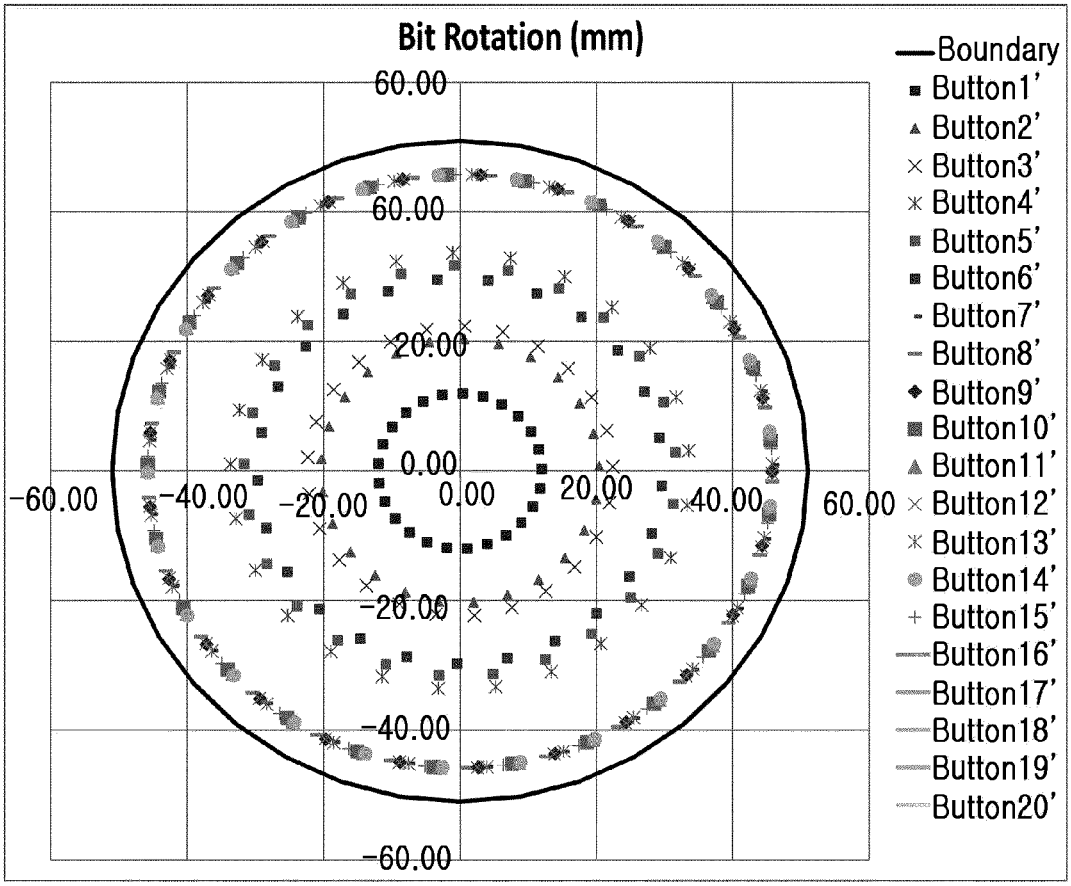

[Fig. 4]
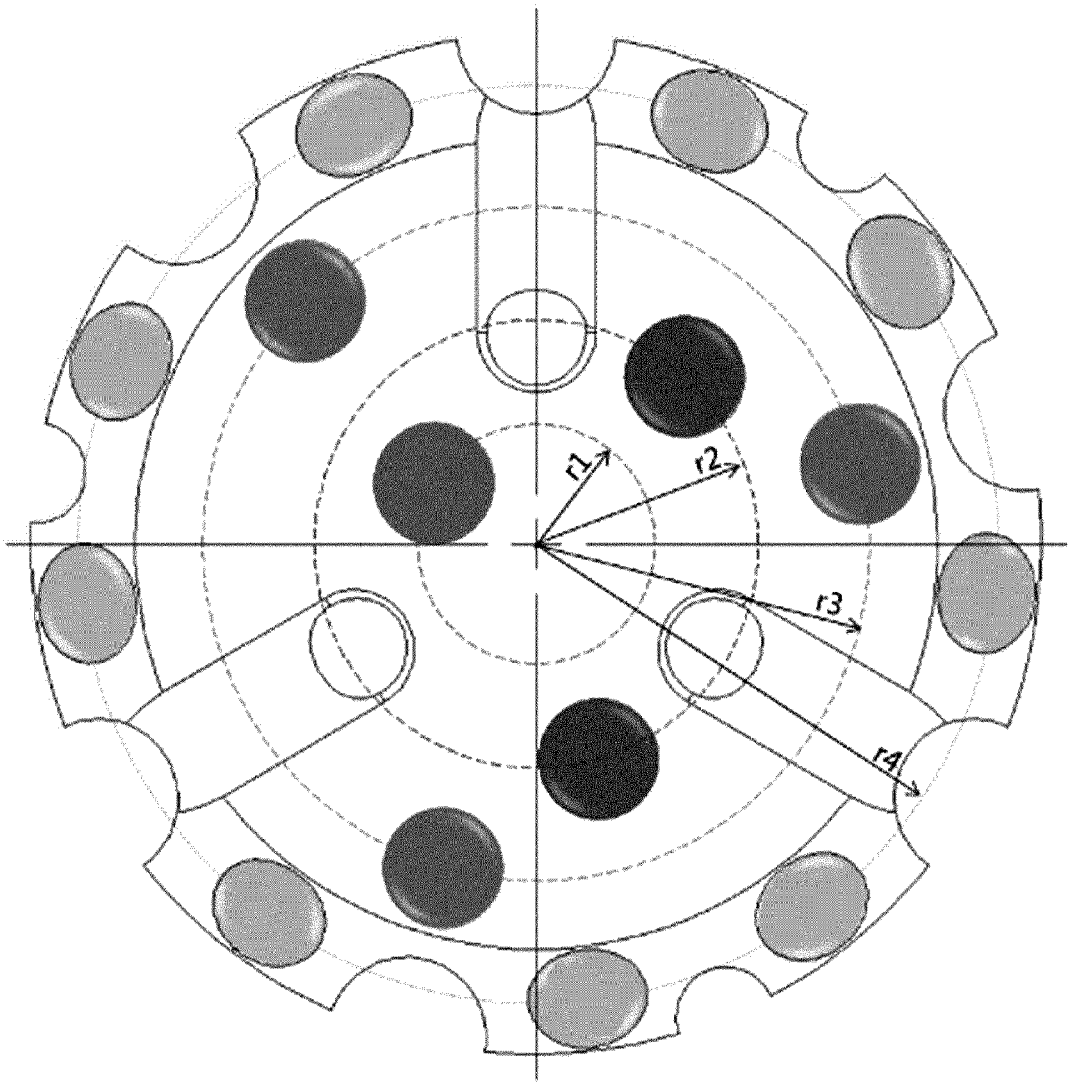

[Fig. 5]
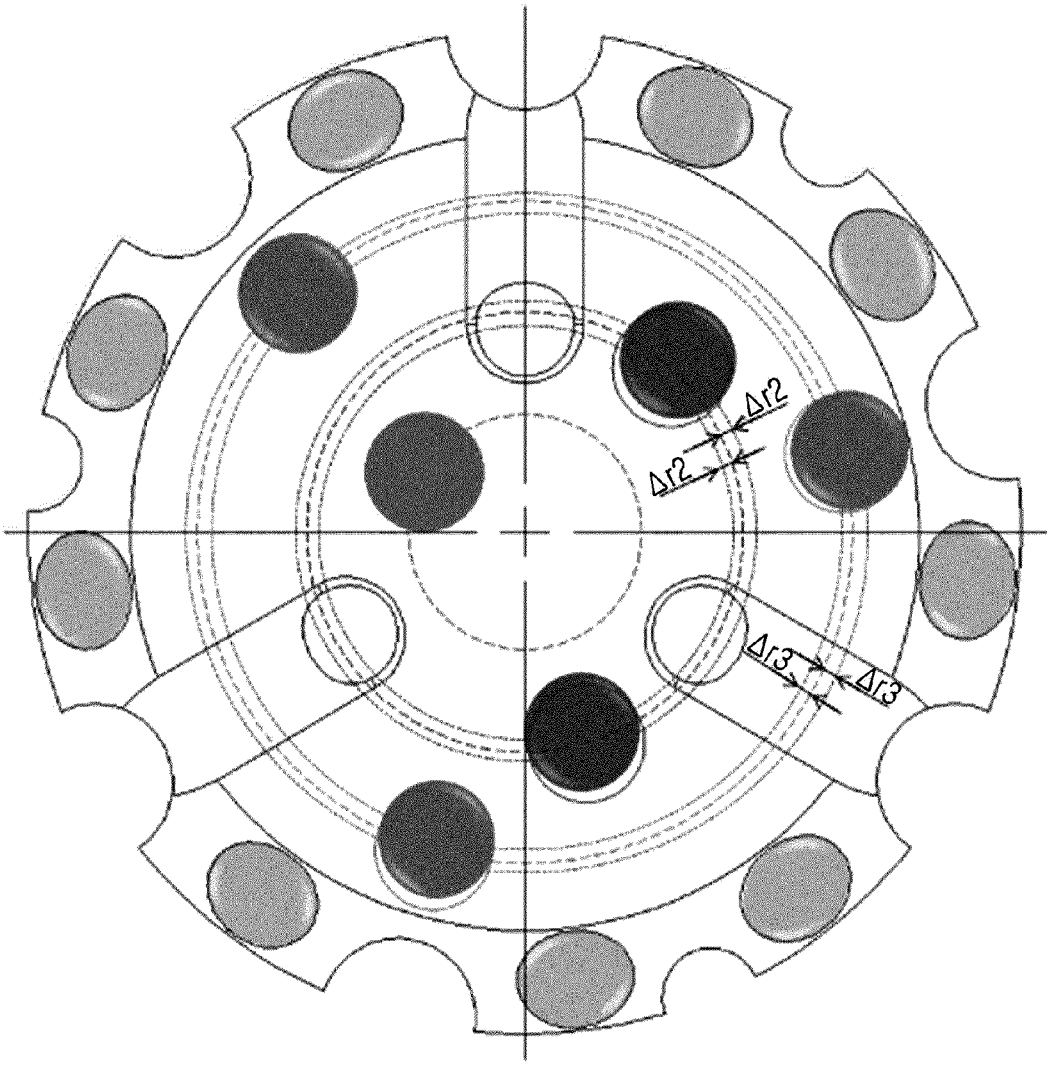

[Fig. 6a]
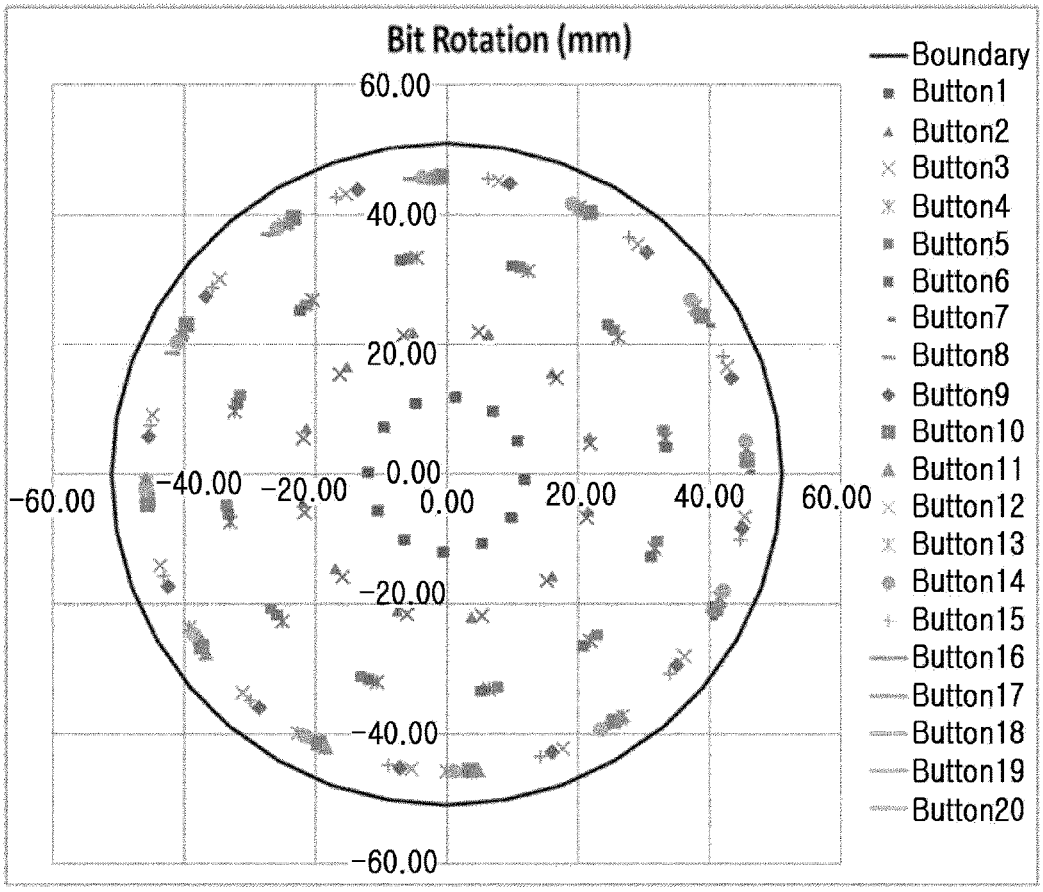

[Fig. 6b]
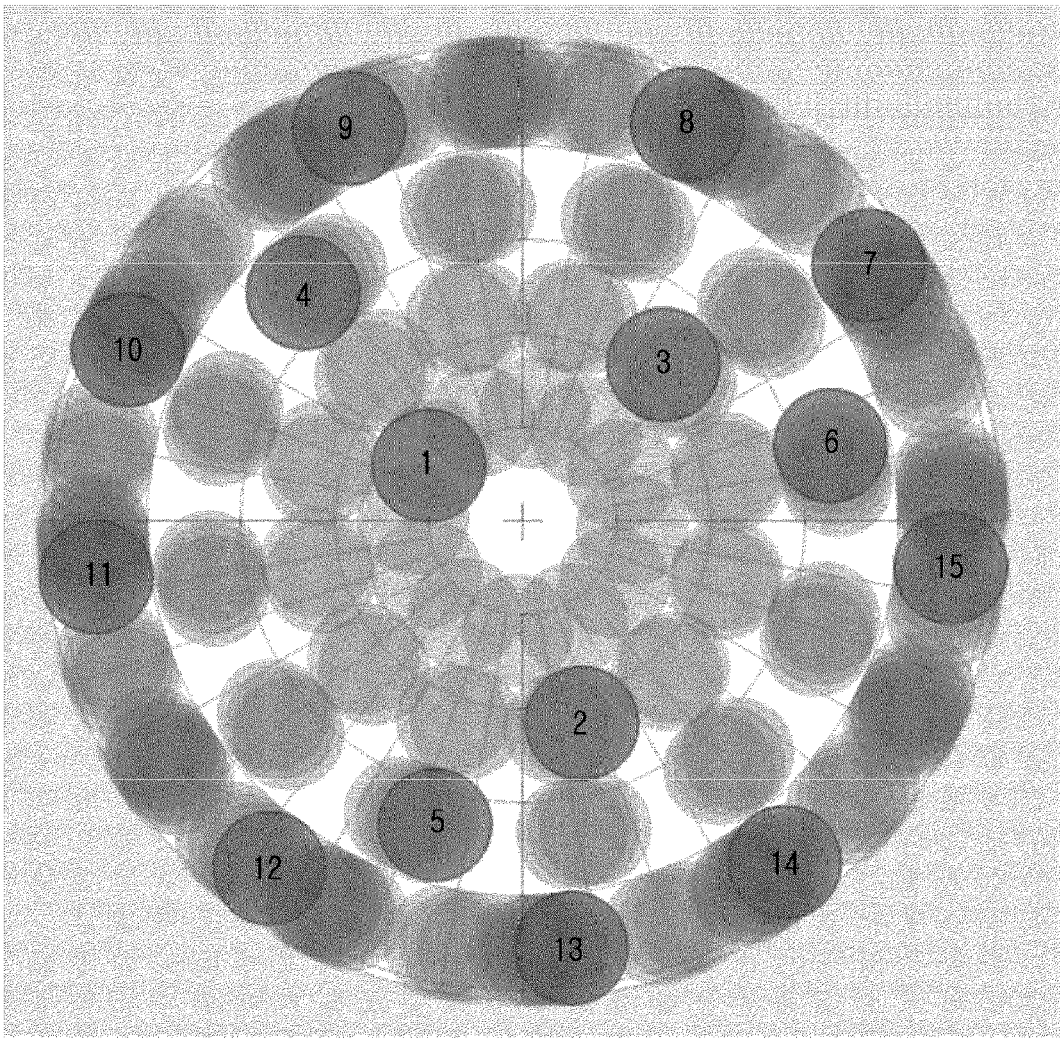

[Fig. 7a]
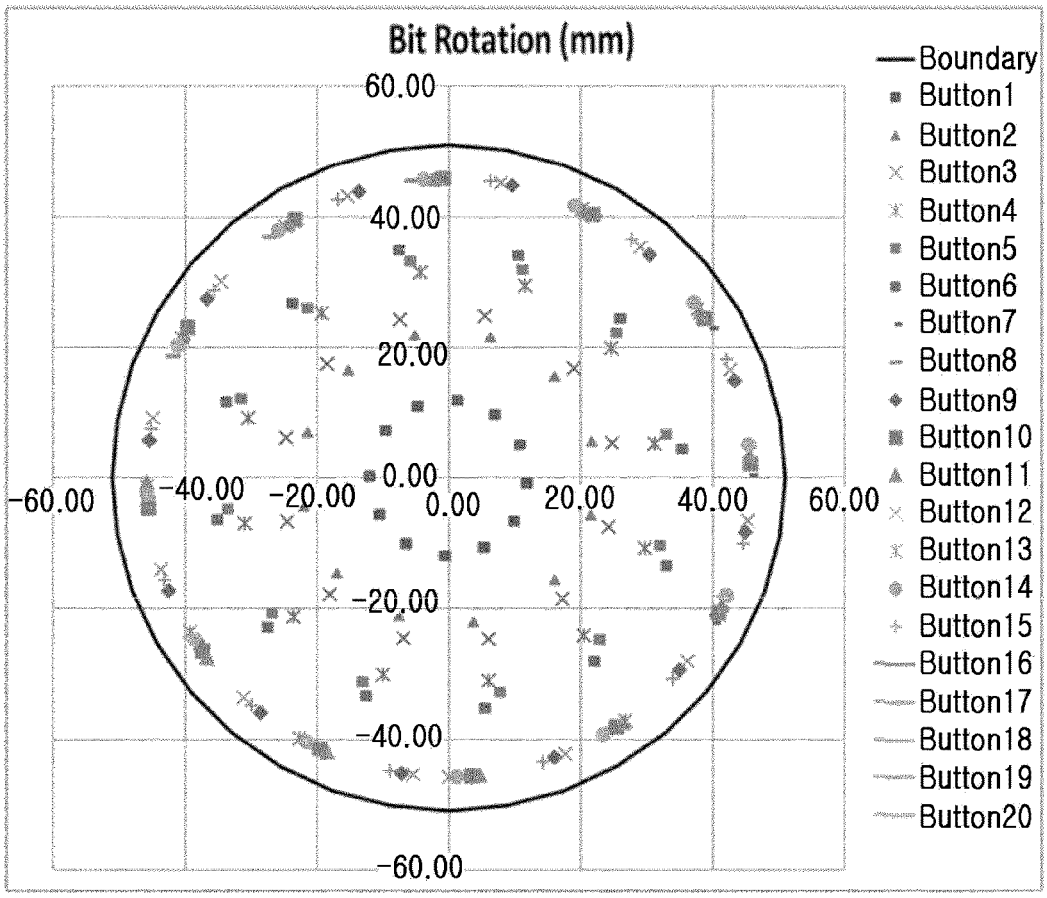

[Fig. 7b]
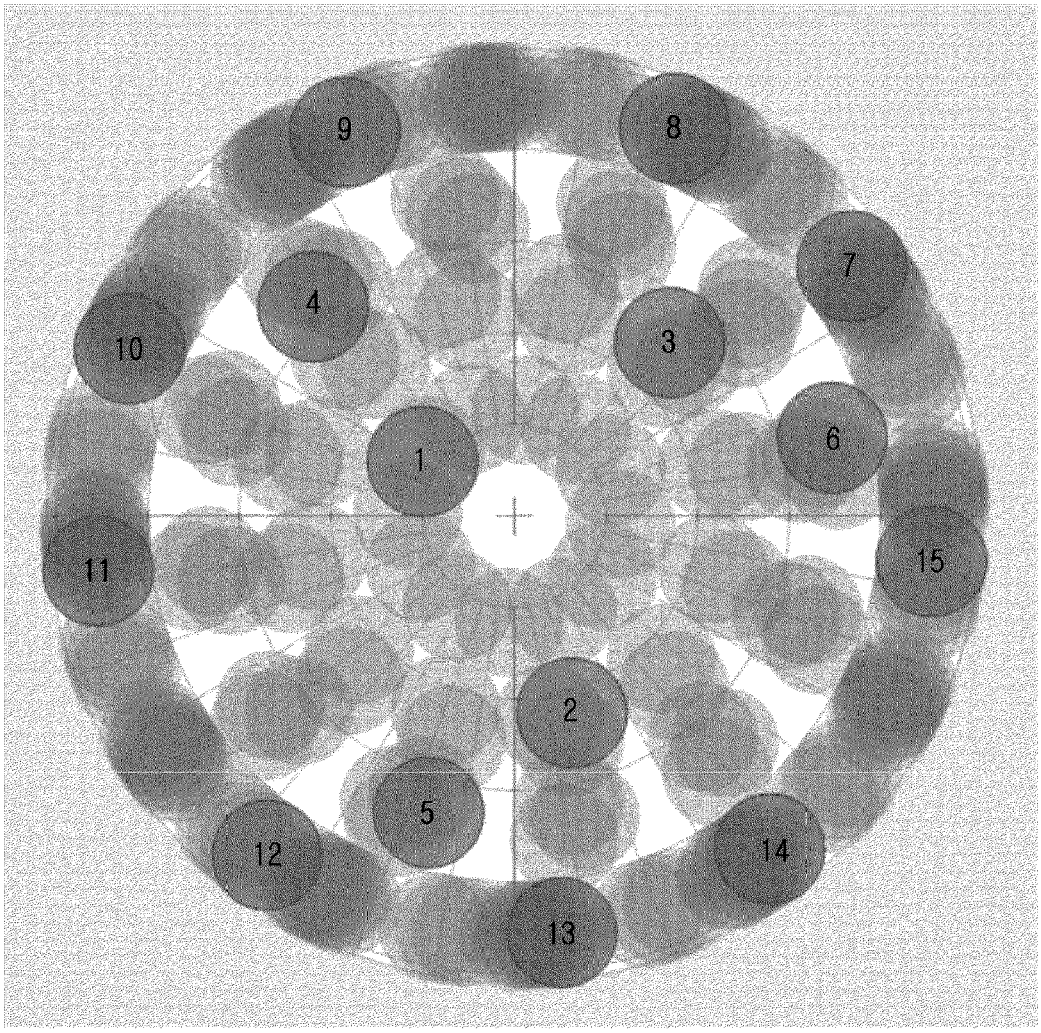

[Fig. 8]
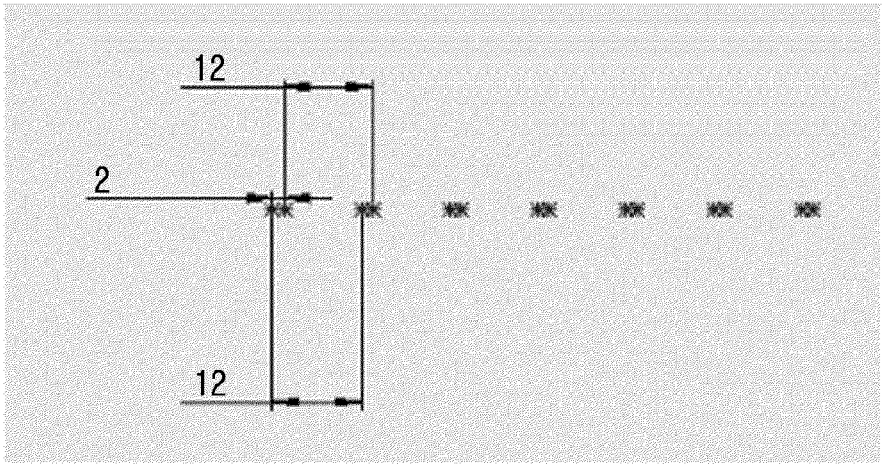
( a )
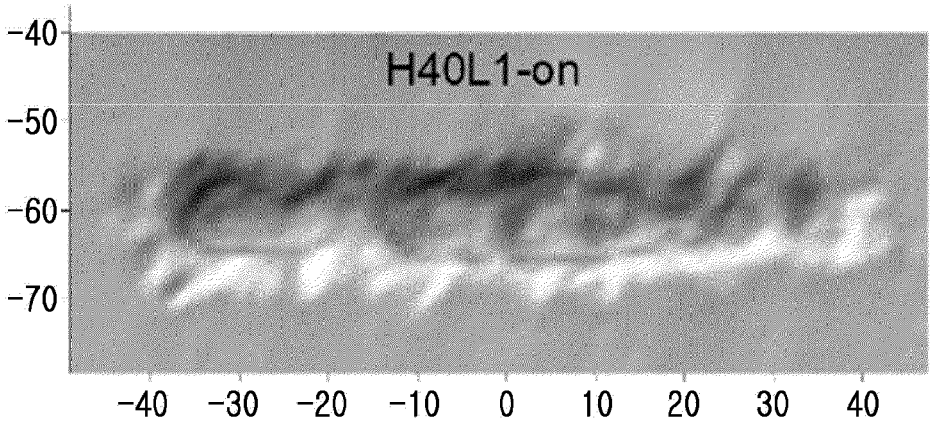
( b )
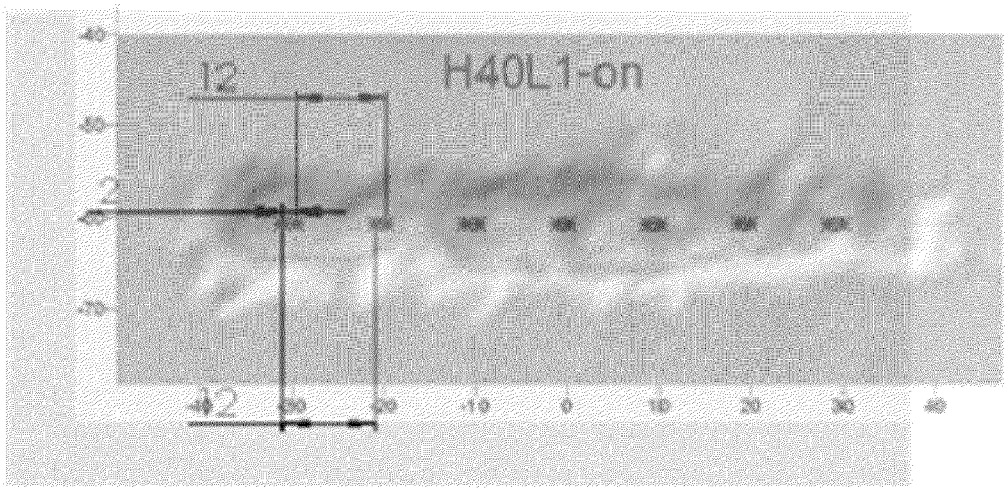
( c )

[Fig. 9]
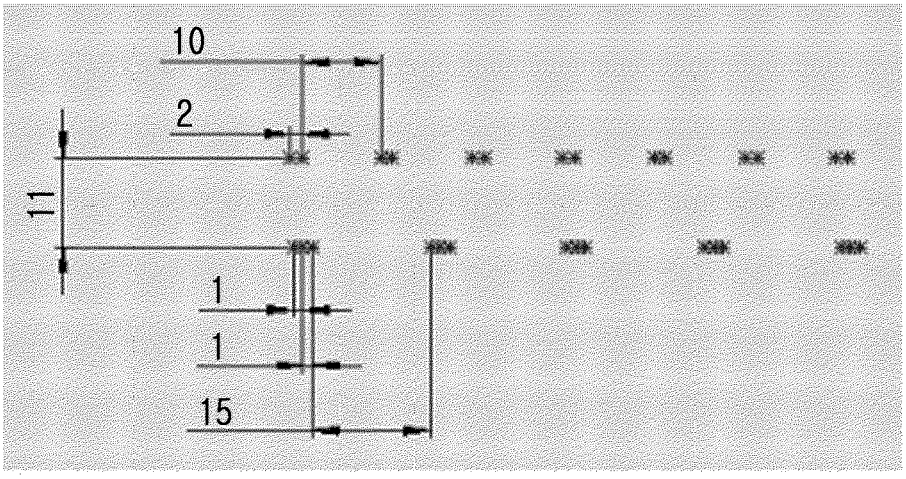
( a )
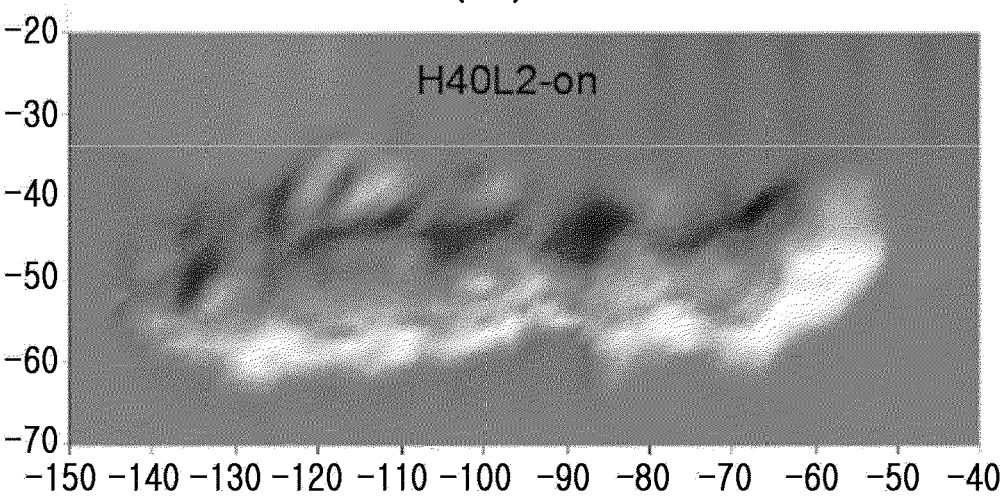
( b )
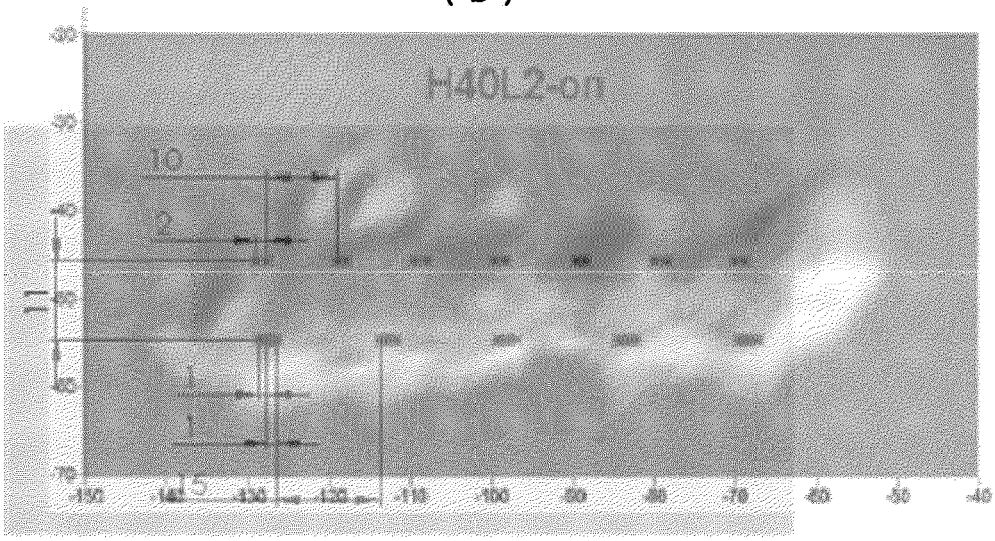
( c )

[Fig. 10]
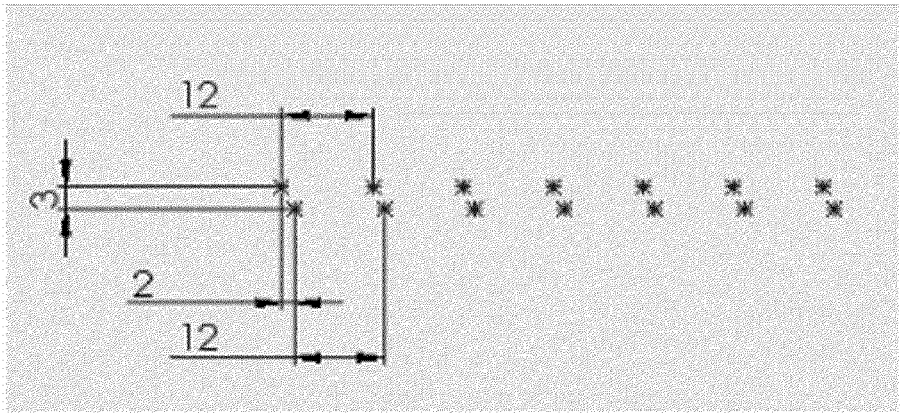
( a )
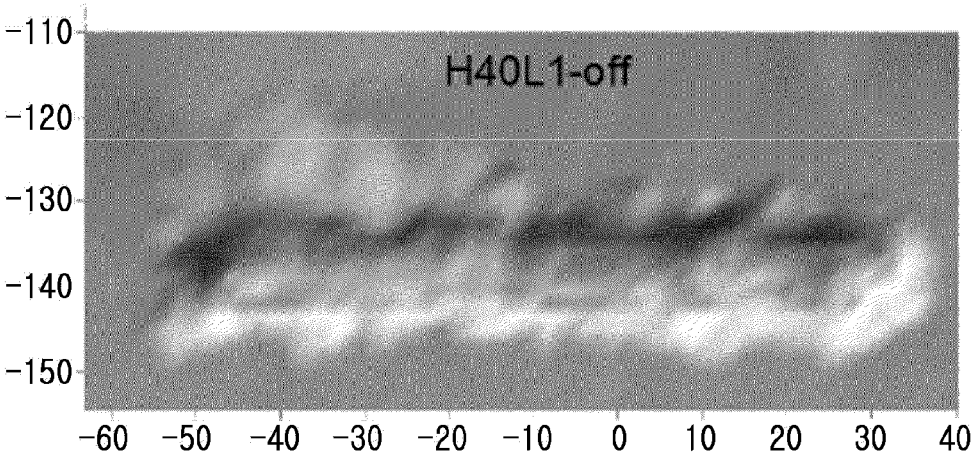
( b )
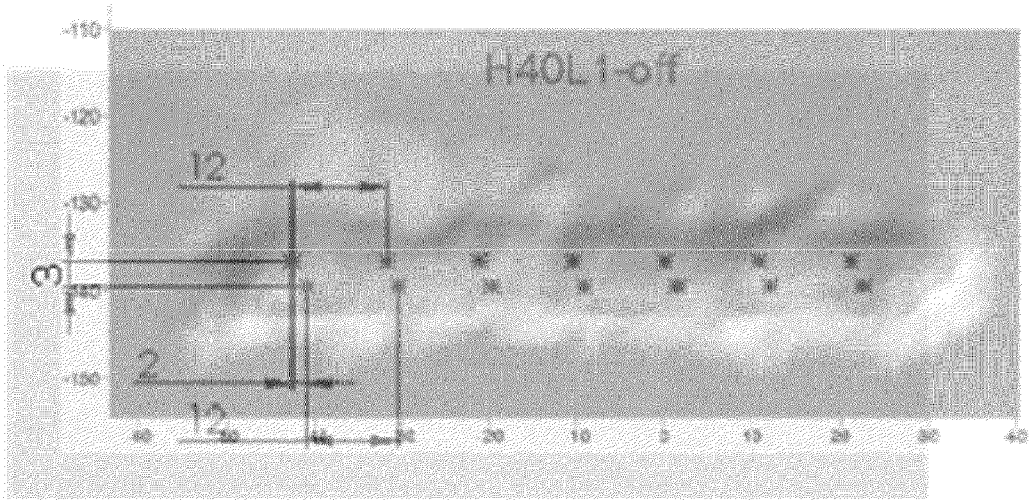
( c )

[Fig. 11]
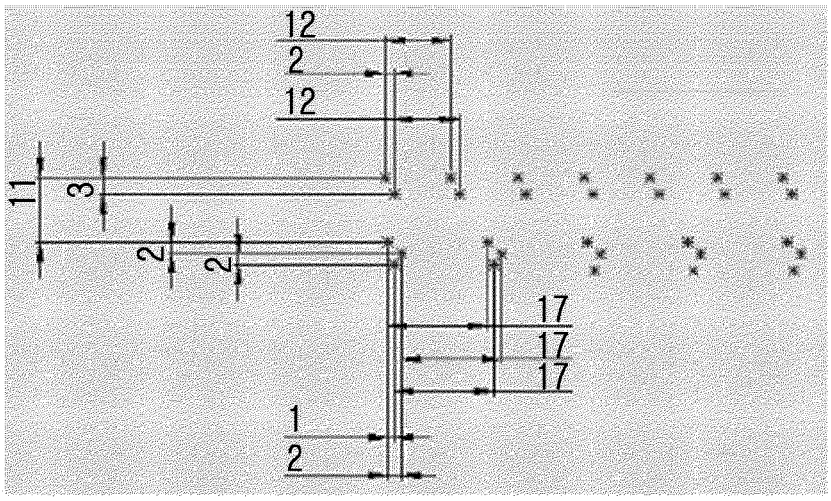
( a )
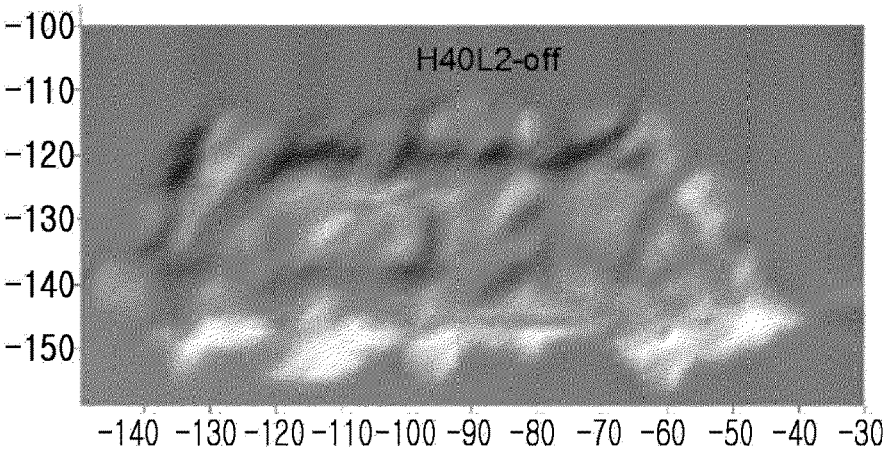
( b )
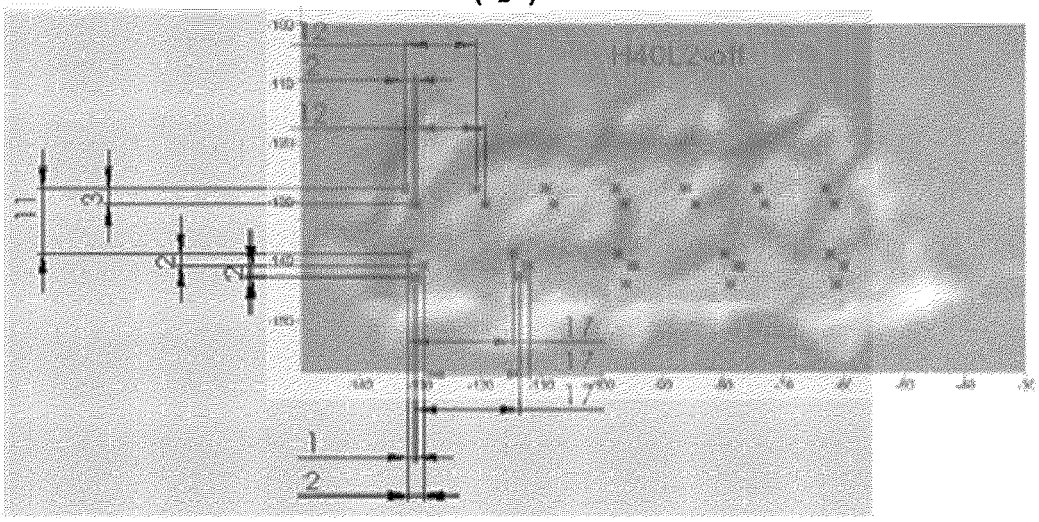
( c )

[Fig. 12]
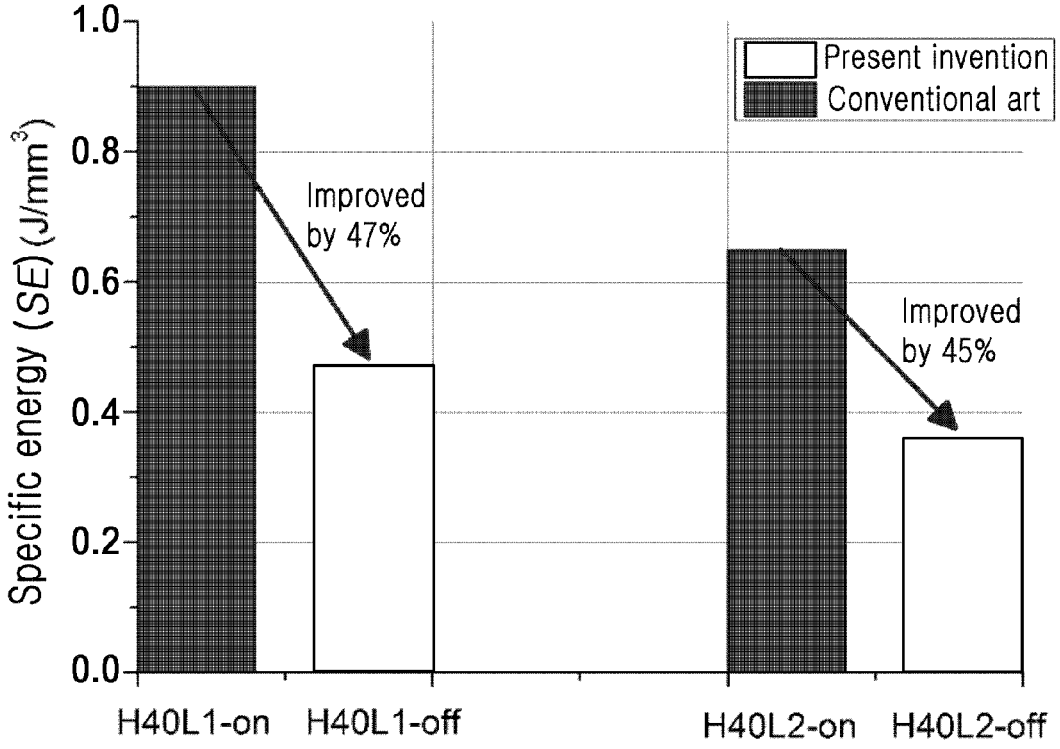

DRILL BIT INCLUDING BUTTON ARRAY HAVING DIFFERENT RADII EXTENDING FROM CENTER OF HEAD SECTION

CROSS-REFERENCE TO RELATED APPLICATION

This application is the U.S. national phase of PCT Application No. PCT/KR2013/004610 filed on May 27, 2013, which claims priority to KR Patent Application No. 10-2012-0066979 filed on Jun. 21, 2012, the disclosures of which are incorporated in their entirety by reference herein.

TECHNICAL FIELD

The present invention relates to a drill bit including a button array having different radii extending from the center of the head thereof and, more particularly, to an invention in which buttons are arranged to have different radii extending from the center of the head of a drill bit, thereby striking bedrock points having different radii and accordingly improving the efficiency of a drilling operation.

BACKGROUND ART

A drill bit used to drill rocks and other materials, performs the operation of breaking rock and forming holes.

A drill bit according to conventional art is described below with reference to FIGS. 1A to 1D.

Referring to FIG. 1*a*, a rock drill bit 10 includes a drill bit head 30 and a skirt 50. The head of the rock drill bit 10 includes a plurality of rock crushing members in the form of buttons on a drill surface that comes into contact with rock. The rock is smashed and crushed by the members.

Referring to FIG. 1*b*, it can be seen that, in an array of drill bit buttons according to the conventional art, buttons 2 and 3 have the same radius r2 from the central axis C of the drill bit 10 and buttons 4 to 6 have the same radius r3.

When the plurality of buttons have the same radius extending from the central axis of the drill bit 10, the striking distribution is different to a certain extent according to the RPM (revolutions per minute) and the BPM (blows per minute).

Referring to FIG. 1*c*, it can be seen that the RPM and the BPM are set to appropriate values (a first condition) and thus relatively different points are struck. In contrast, under a specific RPM and BPM condition (a second condition) identical points may be struck. In this case, it can be seen that some buttons (a third group) strike the same point, as illustrated in FIG. 1*d*.

Accordingly, the drill bit 10 that repeatedly strikes the same point under a specific condition is problematic in that rock crushing efficiency is low and the time it takes to crush rock is excessively long.

(Patent document 1) KR2007-0053285 A (Patent document 2) KR2006-0110271 A

DISCLOSURE

Technical Problem

Accordingly, the present invention has been made keeping in mind the above problems occurring in the prior art, and an object of the present invention is to provide a drill bit that includes a plurality of buttons having different radii extending from the central axis thereof, thereby improving drilling efficiency.

Technical Solution

In order to accomplish the above object, an embodiment of the present invention provides a drill bit, including a plurality of buttons located on a drill surface and configured to perform a grinding operation; wherein the plurality of buttons includes peripheral buttons located in the outer portion of the drill surface; and a plurality of front buttons located in the inner portion of the drill surface, and configured to have different radii (r) from the central axis of the drill bit; and characterized in that striking points that the plurality of front buttons strike while rotating have different radii.

Furthermore, preferably, the plurality of front buttons forms a plurality of groups, and a difference (Δr) between the radii of neighboring buttons in each group ranges from 0.5 to 5 mm.

Furthermore, preferably, the plurality of front buttons forms three groups, and an n-th group has n front buttons (n=1, 2, 3).

Advantageous Effects

According to an embodiment of the present invention, a drill bit that has improved drilling efficiency because a plurality of buttons strikes different points is provided.

In addition, thanks to the improved operation of a drill bit, the operating time it takes to drill a hole can be reduced, and unnecessary energy consumption can be decreased.

DESCRIPTION OF DRAWINGS

FIG. 1*a* is a perspective view of a drill bit according to the conventional art;

FIG. 1*b* is a plan view of the drill bit according to the conventional art;

FIG. 1*c* is a striking point distribution view of the drill bit under the first condition according to the conventional art;

FIG. 1*d* is a striking point distribution view of the drill bit under the second condition according to the conventional art;

FIG. 2 is a plan view of a head of a drill bit according to the present invention;

FIG. 3 is a striking point distribution view of the drill bit according to the present invention;

FIG. 4 is a rear view illustrating the button arrangement method of FIG. 1*a;*

FIG. 5 is a rear view illustrating the button arrangement method of FIG. 2;

FIG. 6*a* is a graph depicting striking points set in accordance with the button arrangement of FIG. 4;

FIG. 6*b* is a rear view of the drill bit illustrating a crushing area that is predicted from FIG. 6*a;*

FIG. 7*a* is a graph depicting striking points set in accordance with the button arrangement of FIG. 5;

FIG. 7*b* is a rear view of the drill bit illustrating a crushing area that is predicted from FIG. 7*a;*

FIGS. 8(*a*) to 8(*c*) are diagrams illustrating two-track striking points, a striking experiment result, and the striking points and a crushing area of FIG. 6*a;*

FIGS. 9(*a*) to 9(*c*) are diagrams illustrating two-track and three-track striking points, a striking experiment result, and the striking points and a crushing area of FIG. 6*a;*

FIGS. 10(*a*) to 10(*c*) are diagrams illustrating two-track striking points, a striking experiment result, and striking points and a crushing area of FIG. 7*a;*

FIGS. 11(*a*) to 11(*c*) are diagrams illustrating two-track and three-track striking points, a striking experiment result, and striking points and a crushing area of FIG. 7*a*; and FIG. 12 is a comparative graph depicting drilling efficiencies according to the conventional art and the present invention.

BEST MODE

A drill bit according to an embodiment of the present invention will be described with reference to FIGS. 2 to 12.

The drill bit 10 according to the embodiment of the present invention includes a plurality of buttons. The buttons are located on the surface of the drill head of the drill bit 10 that comes into contact with rock, that is, a drill surface, and crushes the rock through rotation and striking. The buttons include front buttons 100 and peripheral buttons 200.

The front buttons 100 are located on the drill surface of the drill bit 10, and are preferably located at the inner portion of the drill surface. The buttons 100 may have any shape adapted to crush rocks, and may have a protruding semicircular shape as illustrated in FIG. 1*a*.

The front buttons 100 may be plural in number. In more detail, the plurality of front buttons 100 may form a plurality of groups. According to an example of the present invention, as shown in FIG. 2, the drill bit 10 may form three groups. A first group includes a button 1', and a second group includes buttons 2' and 3'. Furthermore, a third group includes buttons 4' to 6'. That is, an n-th group may include n buttons. Meanwhile, it will be apparent that the number of groups is not limited and also the number of buttons included in each group may be changed.

The plurality of buttons 100 are arranged to have different radii extending from the central axis C of the drill bit 10. That is, when the buttons are moved from a preset location to be arranged to have different radii, one button may be located to have a small radius smaller than that in the case where the button is arranged at the preset location, and the remaining one button may have a radius larger than that in the case where the button is arranged at the preset location. The front buttons 100 arranged at different locations strike different points of bedrock to improve drilling efficiency.

According to an embodiment of the present invention in which a plurality of groups are provided as described above, the difference Δr between the radii of neighboring buttons in a group may range from 0.5 to 5 mm.

Referring to the second group, it can be seen that, in the second group according to the conventional art shown in FIG. 1*b*, the buttons 2 and 3 have the same radius extending from the central axis of the drill bit 10.

In contrast, referring to FIG. 2, according to an embodiment of the present invention, the buttons 2' and 3' of the second group may be away from the location and have different radii r. In more detail, the button 2' may be moved from the preset location toward the central axis of the drill bit 10 and have a smaller radius, and the button 3' may be moved from the preset location to be away from the central axis of the drill bit and have a larger radius.

Referring to the third group, in the third group according to the conventional art shown in FIG. 1*b*, buttons 4 to 6 have the same radius r3 extending from the central axis of the drill bit 10.

Meanwhile, referring to FIG. 2 according to an embodiment of the present invention, the third group includes buttons 4' to 6' as in the conventional art, but each of the buttons are arranged to have different radii extending from the central axis of the drill bit 10.

Likewise, although any array in which buttons have different radii may be used, referring to FIG. 2, the button 4' may be arranged at a preset location, the button 5' may be moved toward the central axis of the drill bit and have a smaller radius, and the button 6' may be moved away from the central axis of the drill bit and have a larger radius. That is, each of the three buttons included in the third group may have different radii.

In this case, the radius difference between neighboring buttons, for example, the radius difference between the button 4' and the button 5' or the radius difference Δr between the button 4' and the button 6' may be various, but may preferably range from 0.5 to 5 mm. Since it is expected that the area of contact between the front buttons 100 and bedrock may form a circle of about 1 mm to 2 mm, it cannot be considered that the front buttons 100 strike different points when Δr is less than 0.5 mm.

Furthermore, since the radius differences between the groups have values between 10 mm and 12 mm, the buttons included in one group fall within the range of influence of another neighboring button group if Δr is more than 5 mm, and thus it is reasonable to limit Δr to 5 mm or less.

However, even in the same group, the radius difference between buttons which are not adjacent to each other (for example, the radius difference between the button 5' and button 6' of the third group) may not be the same as described above.

The peripheral buttons 200 are located in the outer portion of the drill surface of the drill bit 10 that comes into contact with a rock. The peripheral buttons 200 may also be plural in number, preferably seven to ten. According to an example of the present invention, the number of the peripheral buttons 200 may be nine, as illustrated in FIG. 2.

Referring to FIG. 3, striking points according to an embodiment of the present invention will be described. In the embodiment of the present invention, it can be seen that the striking points of a plurality of buttons do not overlap each other.

In addition, it can be seen that the striking distribution of another point has striking points having radii different to a certain extent from those of a striking distribution according to the conventional art (see FIGS. 1*c* and 1*d*). For example, it can be seen that the striking points of the button 2' and the button 3' have different radii to a certain extent from the central axis of the drill bit. That is, as compared with the conventional art, it can be seen that different points can be struck under any condition.

FIG. 4 is a rear view illustrating the button arrangement method of FIG. 1*a* according to the conventional art. As illustrated in this drawing, one red button is located in a first track corresponding to a first radius r1, two blue buttons are located in a second track corresponding to a second radius r2, three green buttons are located in a third track corresponding to a third radius r3, and nine yellow buttons are located in a fourth track corresponding to a fourth radius r4.

The first to fourth tracks are virtual tracks. The buttons located in each of the second track, the third track and the fourth track are located on the same circumference, and strike points on each of the second radius r2, the third radius r3, and the fourth radius r4 on bedrock.

According to the conventional art, since the buttons in the second, third, and fourth tracks strike the same points under a condition including a specific RPM and a specific BPM, a disadvantage arises in that drilling efficiency may be lowered.

Meanwhile, FIG. 5 is a rear view illustrating the button arrangement method of FIG. 2 according to the present invention, in which tracks and radii are set in the same manner as mentioned above.

According to the present invention, a method in which, when a button array is designed, the locations of the buttons of the second track r2 and the third track r3 in the facial portion of the drill bit (distances from the central point) are moved from the same circumferences by Δr is applied. In this case, it is preferable that Δr ranges from 0.5 to 5 mm.

The button arrangement method according to the present invention has the advantage of improving drilling efficiency because different points of bedrock are struck regardless of the drilling RPM and BPM.

Striking points, striking locations and crushing areas according to the button arrangement methods of the conventional art and the present invention are compared with each other with reference to FIGS. 6 to 11 below.

An experimental condition is set to a striking condition in which the same points are repeatedly struck. The striking points of a drill bit according to the conventional art and the striking points of a drill bit according to the present invention are compared with each other and also analyzed by applying a condition in which the striking points of buttons are not uniformly distributed on the surface of bedrock.

In addition, the striking locations and crushing areas of the drill bit according to the present invention are analyzed by applying an array in which the second and third tracks have been moved from the circumferences of the tracks with Δr set to 2 mm.

In this case, the struck curved tracks of the second and third tracks are converted into rectilinear tracks for the convenience of tests, rock striking tests are conducted, specific energies are obtained by measuring striking energies and crushed volumes, and then drilling efficiencies are compared with each other.

The above process and the result thereof are illustrated in FIGS. 6 to 11. When striking points according to the button array according to the conventional art and the present invention are set, RPMs are set to the same value of 180 RPM and BPMs are set to the same value of 2200 BPM.

Furthermore, FIGS. 8(*a*), 8(*b*) and 8(*c*) illustrate two-track striking points, striking experiment results, and striking points and crushing areas using test specimen H40L1-on, and FIGS. 9(*a*), 9(*b*) and 9(*c*) illustrate two-track and three-track striking points, striking experiment results, and striking points and crushing areas using test specimen H40L2-on.

Furthermore, FIGS. 10(*a*), 10(*b*) and 10(*c*) illustrate two-track striking points, striking experiment results, and striking points and crushing areas using test specimen H40L1-off, and FIGS. 11(*a*), 11(*b*) and 11(*c*) illustrate two-track and three-track striking points, striking experiment results, and striking points and crushing areas using test specimen H40L2-off.

The rock striking experiment results are illustrated in Table 1.

TABLE 1

| | Specimen number | Number of strikes | Crushed volume ($mm^3$) | Striking energy (J) | Specific energy (SE) ($J/mm^3$) | Improvement of drilling efficiency (%) |
|---|---|---|---|---|---|---|
| Button array of conventional art | H40L1-on (FIG. 8) | 14 | 1963.3 | 1772.4 | 0.90 | — |
| | H40L2-on (FIG. 9) | 28 | 5479.7 | 3557.0 | 0.65 | — |
| Button array of present invention | H40L1-off (FIG. 10) | 14 | 3749.9 | 1778.8 | 0.47 | 47% |
| | H40L2-off (FIG. 11) | 32 | 11352.9 | 400.1 | 0.36 | 45% |

Furthermore, specific energy (SE) is a value obtained by dividing striking energy by a crushed rock volume, and can be calculated by applying the striking energy and crushed rock volumes of Table 1 to Equation 1:

$$\text{Specific energy } (SE)(J/mm^3) = \frac{\text{Striking energy (J)}}{\text{Crushed rock volume } (mm^3)} \quad (1)$$

FIG. 12 is a comparison graph illustrating drilling efficiencies according to the conventional art and the present invention. Specific energies according to the conventional art and the present invention are compared and analyzed using Equation 1.

As illustrated in FIG. 12, it can be seen that, when the second track was selected for striking points, the present invention (H40L1-off) improved specific energy by 47% compared to the conventional art (H40L1-on). Furthermore, when the second and third tracks were selected for striking points, the present invention (H40L2-off) improved specific energy by 45% compared to the conventional art (H40L2-on).

It will be apparent to those skilled in the art that various modifications and variations can be made without departing from the spirit of the present invention. Accordingly, the technical range of the present invention is not limited to the specific details given in the detailed description of the present invention, but should be determined based on the attached claims.

The invention claimed is:

1. A drill bit, comprising a plurality of buttons located on a drill surface and configured to perform a striking and rotating operation;

wherein the plurality of buttons comprises:

nine peripheral buttons located in an outer portion of the drill surface; and a plurality of front buttons located in an inner portion of the drill surface;

wherein the plurality of front buttons configured to form three groups, the first group includes one front button, the second group includes two circumferentially spaced apart front buttons and the third group includes three circumferentially spaced apart front buttons, the one front button of the first group is located at a predetermined first radius $r_1$ from the central axis of the drill bit, one of the two front buttons of the second group is located toward the central axis of the drill bit by a radial difference Δr with reference to a predetermined second radius $r_2$, the other front button of the second group is located away from the central axis of the drill bit by the radial difference Δr with reference to the predetermined second radius $r_2$, one of the three front buttons of the third group is located at a predetermined third radius $r_3$ from the central axis of the drill bit, another front button of the third group is located toward the central axis of the drill bit by a radial difference Δr with reference to the predetermined third radius $r_3$, the other front button of the third group is located away from the central axis of the drill bit by the radial difference Δr with reference to the predetermined third radius $r_3$, a plurality of side grooves extending downward from the outer portion of the drill surface are formed on a side surface of the drill bit, the drill surface is provided with a plurality of drill surface grooves communicating with the corresponding side grooves and extending from the outer side of the drill surface toward the central axis of the drill bit, one of the front buttons of the second group and one of the front buttons of the third group are located between two adjacent drill surface grooves, and the radial difference Δr is from 0.5 to 5 mm.

2. The drill bit of claim 1, wherein the predetermined second radius $r_2$ is larger than the predetermined radius $r_1$, and wherein the predetermined third radius $r_3$ is larger than the predetermined radius $r_2$.

3. The drill bit of claim 1, wherein the plurality of front buttons protrude in a semicircular shape on the drill surface.

4. The drill bit of claim 1, the radial difference Δr is about 2 mm.

5. The drill bit of claim 1, further comprising a series of spaced apart peripheral buttons radially located adjacent the outer peripheral edge of the of the drill surface.

* * * * *